US010653262B1

(12) United States Patent
Isreal

(10) Patent No.: US 10,653,262 B1
(45) Date of Patent: May 19, 2020

(54) PARCEL SECURING ASSEMBLY

(71) Applicant: Lillian Isreal, Winterville, NC (US)

(72) Inventor: Lillian Isreal, Winterville, NC (US)

( * ) Notice: Subject to any disclaimer, the term of this patent is extended or adjusted under 35 U.S.C. 154(b) by 0 days.

(21) Appl. No.: 16/177,963

(22) Filed: Nov. 1, 2018

(51) Int. Cl.
*A47G 29/20* (2006.01)
*A47G 29/22* (2006.01)
*A47G 29/124* (2006.01)
*A47G 29/14* (2006.01)

(52) U.S. Cl.
CPC ..... *A47G 29/20* (2013.01); *A47G 29/22* (2013.01); *A47G 2029/1257* (2017.08); *A47G 2029/144* (2013.01)

(58) Field of Classification Search
CPC ..... A47G 29/14; A47G 29/16; A47G 29/20; A47G 29/1251; A47G 29/22; A47G 2029/1257; A47G 2029/144; A47G 2029/148; B65D 55/14; A47C 13/00; E05B 65/2507; E05B 65/5215; E05B 65/5223
USPC ..... 232/44, 45, 38, 39, 19; 297/118; 70/63, 70/134
See application file for complete search history.

(56) References Cited

U.S. PATENT DOCUMENTS 986,686 A * 3/1911 Carney ..... A47B 85/04 297/123
1,309,097 A 7/1919 Markwick
5,884,795 A 3/1999 Godbersen
D427,788 S 7/2000 Paul
6,300,873 B1 * 10/2001 Kucharczyk ..... A47G 29/141 235/382.5
6,375,070 B1 * 4/2002 Snoke ..... A47G 29/141 232/20
6,967,575 B1 * 11/2005 Dohrmann ..... A47G 29/141 220/592.01
7,175,071 B1 * 2/2007 Slagle ..... A47G 29/16 220/833
7,597,256 B2 10/2009 Stevens
8,358,199 B2 * 1/2013 Nesling ..... A47G 29/141 232/20
9,327,887 B2 5/2016 Farentinos
9,596,952 B2 3/2017 Mencel
9,619,955 B2 4/2017 Eichenblatt
9,630,757 B1 * 4/2017 Capous ..... B65D 55/14
10,039,401 B1 * 8/2018 Romanucci ..... A47G 29/141
10,292,519 B1 * 5/2019 Sutton ..... A47G 29/1209
2001/0045449 A1 * 11/2001 Shannon ..... A47G 29/141 232/19
2005/0253715 A1 * 11/2005 Awobue ..... A47G 29/1214 340/569
2008/0142522 A1 * 6/2008 Maid ..... A47G 29/20 220/324

(Continued)

*Primary Examiner* — William L Miller

(57) ABSTRACT

A parcel securing assembly includes a box that is positionable on a horizontal support surface proximate an entrance to a building. The box has a delivery opening therein for receiving a delivered parcel. A door is hingedly coupled to the box and the door is aligned with the delivery opening for opening and closing the delivery opening. A locking unit is coupled to the box, and the locking unit is operationally coupled to the door. The locking unit is urgeable into a locked condition when the door is opened such that the locking unit locks the door when the door is subsequently closed. In this way the locking unit secures the delivered parcel in the box until an authorized user unlocks the locking unit.

4 Claims, 3 Drawing Sheets

(56) References Cited

U.S. PATENT DOCUMENTS

| | | | | |
|---|---|---|---|---|
| 2009/0166403 | A1* | 7/2009 | Volpe | A47G 29/141<br>235/375 |
| 2016/0309939 | A1* | 10/2016 | Mencel | A47G 29/20 |
| 2017/0251856 | A1* | 9/2017 | Schaible | A47G 29/141 |
| 2018/0070753 | A1* | 3/2018 | Eveloff | H04W 12/08 |
| 2018/0303265 | A1* | 10/2018 | Hearne | A47G 29/12095 |
| 2018/0310714 | A1* | 11/2018 | Becker | A47C 11/00 |
| 2019/0000255 | A1* | 1/2019 | Dehner | B65D 43/164 |
| 2019/0167025 | A1* | 6/2019 | Cherry | A47G 29/141 |
| 2019/0239650 | A1* | 8/2019 | Nelson | A47C 1/14 |
| 2019/0239673 | A1* | 8/2019 | Silva | A47G 29/28 |

* cited by examiner

PARCEL SECURING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to securing devices and more particularly pertains to a new securing device for securing a delivered parcel in a box until an authorized user unlocks the box.

BRIEF SUMMARY OF THE INVENTION

An embodiment of the disclosure meets the needs presented above by generally comprising a box that is positionable on a horizontal support surface proximate an entrance to a building. The box has a delivery opening therein for receiving a delivered parcel. A door is hingedly coupled to the box and the door is aligned with the delivery opening for opening and closing the delivery opening. A locking unit is coupled to the box, and the locking unit is operationally coupled to the door. The locking unit is urgeable into a locked condition when the door is opened such that the locking unit locks the door when the door is subsequently closed. In this way the locking unit secures the delivered parcel in the box until an authorized user unlocks the locking unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
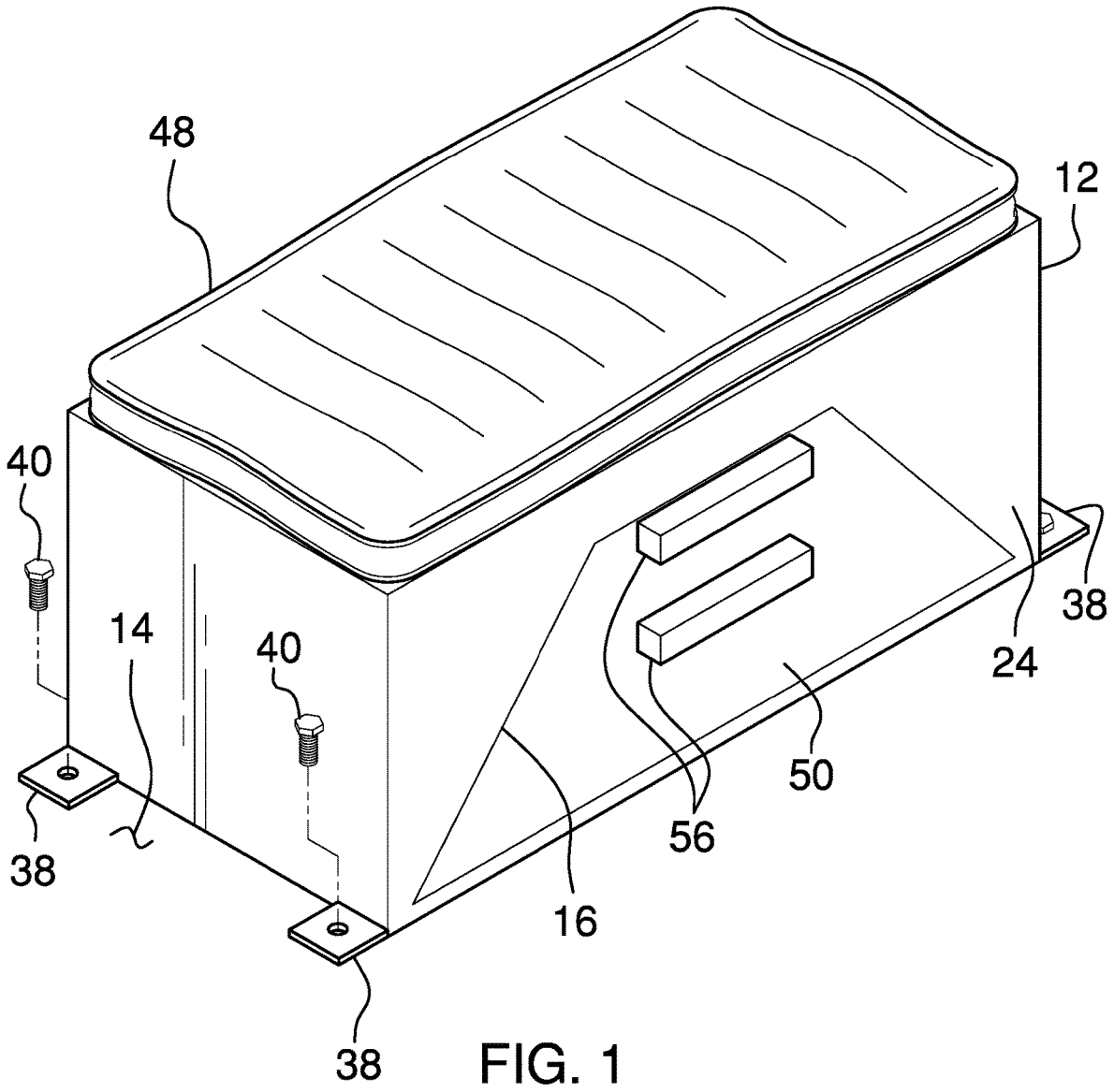
FIG. 1 is a top perspective view of a parcel securing assembly according to an embodiment of the disclosure.
Figure 2:
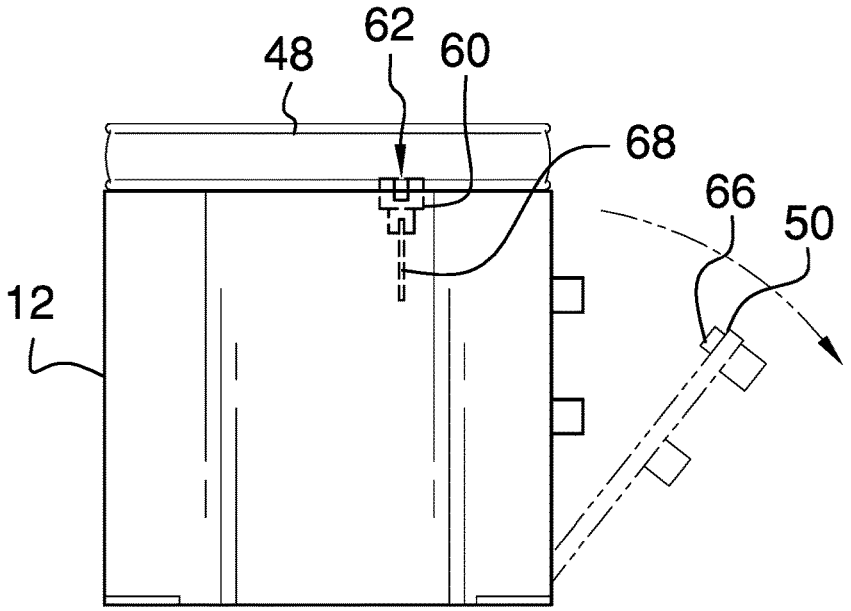
FIG. 2 is a left side phantom view of an embodiment of the disclosure.
Figure 3:
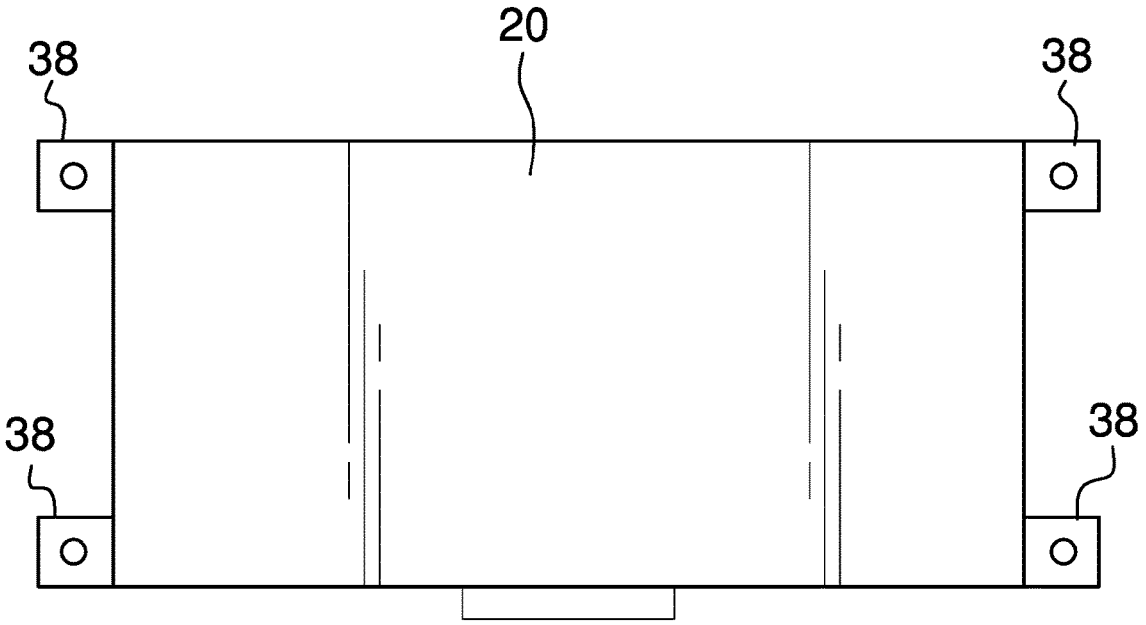
FIG. 3 is a bottom view of an embodiment of the disclosure.
Figure 4:
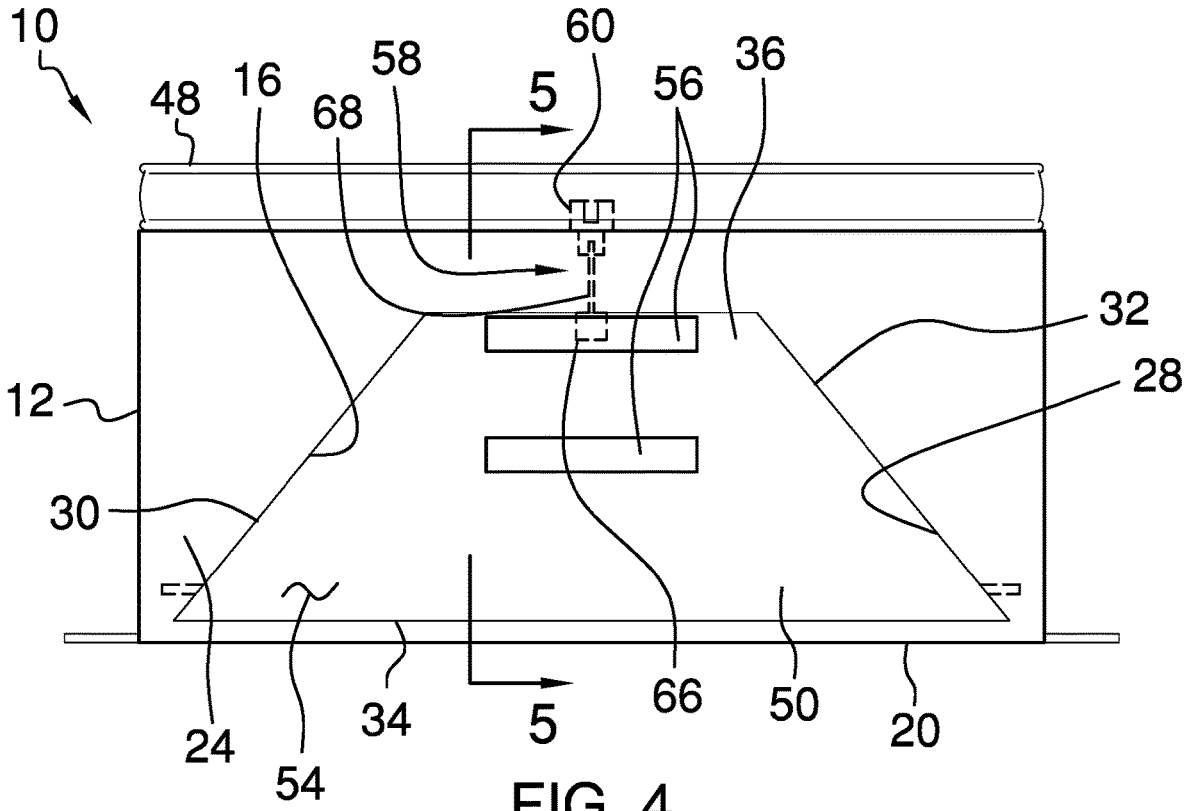
FIG. 4 is a front phantom view of an embodiment of the disclosure.
Figure 5:
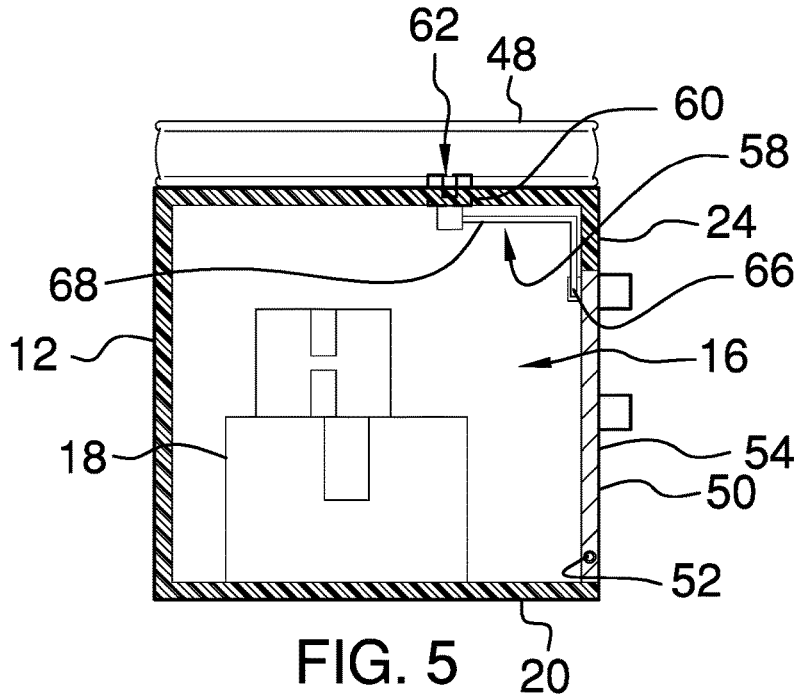
FIG. 5 is a cross sectional view taken along line 5-5 of FIG. 4 of an embodiment of the disclosure.

With reference now to the drawings, and in particular to FIGS. 1 through 5 thereof, a new securing device embodying the principles and concepts of an embodiment of the disclosure and generally designated by the reference numeral 10 will be described.

As best illustrated in FIGS. 1 through 5, the parcel securing assembly 10 generally comprises a box 12 that is positionable on a horizontal support surface 14 proximate an entrance to a building. The building may be a residence, an office building or any other building to which a parcel 18 may be delivered. The box 12 has a delivery opening 16 therein for receiving a delivered parcel 18. The box 12 has a bottom wall 20, a top wall 22 and a front wall 24. Additionally, the delivery opening 16 extends through the front wall 24 of the outer wall 22 and into an interior of the box 12. The delivery opening 16 has a bounding edge 28, and the bounding edge 28 has a first lateral side 30, a second lateral side 32, a bottom side 34 and a top side 36. Each of the first 30 and second 32 lateral sides angle inwardly between the bottom 34 and top 36 sides such that the delivery opening 16 has a trapezoidal shape.

A plurality of tabs 38 is each coupled to and extends laterally away from the box 12 and each of the tabs 38 rests on the support surface 14. Each of the tabs 38 has a fastener 40 extended therethrough that engages the support surface 14 for retaining the box 12 on the support surface 14. In this way the box 12 is inhibited from being stolen when the delivered parcel 18 is positioned in the box 12. Each of the tabs 38 is positioned on the outer wall 22 of the box 12 and is aligned with the bottom wall 20 of the box 12. Additionally, the tabs 38 are spaced apart from each other and are distributed around the box 12. A cushion 48 is positioned on the top surface 44 of the box 12 for sitting upon.

A door 50 is hingedly coupled to the box 12 and the door 50 is aligned with the delivery opening 16 for opening and closing the delivery opening 16. The door 50 is positioned on the front wall 24 of the outer wall 22 of the box 12 and the door 50 is aligned with the delivery opening 16. The door 50 has an inwardly facing surface 52 and an outwardly facing surface 54. A pair of grips 56 is each coupled to the outwardly facing surface 54 of the door 50 for gripping while opening and closing the door 50.

A locking unit 58 is coupled to the box 12 and the locking unit 58 is operationally coupled to the door 50. The locking unit 58 is urgeable into a locked condition when the door 50 is opened such that the locking unit 58 locks the door 50 when the door 50 is subsequently closed. In this way the locking unit 58 secures the delivered parcel 18 in the box 12 until an authorized user unlocks the locking unit 58. The locking unit 58 comprises a first lock 60 that is coupled to the top wall 22 of the box 12 and the first lock 60 extends through the top wall 22 of the box. The cushion conceals the first lock 60 when the cushion is positioned on the box 12.

The first lock 60 has a key hole 62 that is exposed with respect to the top wall 22. A key or the like is insertable into the key hole 62 for unlocking the locking unit 58. A second lock 66 is coupled to the inwardly facing surface 52 of the door 50. An armature 68 is movably coupled between the first 60 and second 66 locks. The armature 68 engages the second lock 66 when the locking unit 58 is urged into the locking position. In this way the door 50 is inhibited from being opened when the parcel 18 is placed in the box 12 and the lid 42 is closed. Additionally, the armature 68 disengages the second lock 66 when the key 64 is inserted into the key hole 62 for unlocking the locking unit 58.

In use, a delivery person opens the door 50 and positions the parcel 18 into the box 12 and the delivery person closes the door 50. Moreover, the locking unit 58 is urged into the locked condition when the door 50 is opened and subsequently closed. Thus, the door 50 is locked thereby securing the parcel 18 in the box 12. The authorized user inserts the key 64 into the first lock 60 for unlocking the first 60 and second 66 locks. Thus, the door 50 can be opened for retrieving the parcel 18 from the box 12. In this way the locking unit 58 is reset for subsequently locking the door 50 when the door 50 is opened and closed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A parcel securing assembly being configured to receive a delivered parcel for secure storage, said assembly comprising:

a box being positionable on a horizontal support surface proximate an entrance to a building, said box having a delivery opening therein for receiving a delivered parcel, said box having a bottom wall, a top wall and a front wall, said delivery opening extending through said front wall and into an interior of said box, said delivery opening having a bounding edge, said bounding edge having a first lateral side, a second lateral side, a bottom side and a top side, each of said first and second lateral sides angling inwardly between said bottom and top sides such that said delivery opening has a trapezoidal shape;

a door being hingedly coupled to said box, said door being aligned with said delivery opening for opening and closing said delivery opening;

a locking unit being coupled to said box, said locking unit being operationally coupled to said door, said locking unit being urgeable into a locked condition when said door is opened such that said locking unit locks said door when said door is subsequently closed, wherein said locking unit secures the delivered parcel in said box until an authorized user unlocks said locking unit, said locking unit comprising a first lock being coupled to said top wall of said box, said lock extending through said top wall of said box, said first lock having a key hole being exposed with respect to said top wall, and a second lock being coupled to an inwardly facing surface of said door;

a plurality of tabs, each of said tabs being coupled to and extending laterally away from said box, each of said tabs resting on the support surface, each of said tabs having a fastener extended therethrough and engaging the support surface for retaining said box on the support surface, each of said tabs being aligned with said bottom wall of said box, said tabs being spaced apart from each other and being distributed around said box; and a cushion being positioned on said top wall of said box wherein said cushion is configured to be sat upon.

2. The assembly according to claim 1, further comprising:

said door being positioned on said front wall of said box, said door being aligned with said delivery opening, said door having an inwardly facing surface and an outwardly facing surface; and a pair of grips, each of said grips being coupled to said outwardly facing surface of said door for gripping while opening and closing said door.

3. The assembly according to claim 1, further comprising an armature being movably coupled between said first and second locks, said armature engaging said second lock when said locking unit is urged into said locking position, said armature disengaging said second lock when a key is inserted into said key hole for unlocking said locking unit.

4. A parcel securing assembly being configured to receive a delivered parcel for secure storage, said assembly comprising:

a box being positionable on a horizontal support surface proximate an entrance to a building, said box having an delivery opening therein for receiving a delivered parcel, said box having a delivery opening therein for retrieving the delivered parcel from said box, said box having a bottom wall, a top wall and a front wall, said delivery opening extending through said front wall and into an interior of said box, said delivery opening having a bounding edge, said bounding edge having a first lateral side, a second lateral side, a bottom side and a top side, each of said first and second lateral sides angling inwardly between said bottom and top sides such that said delivery opening has a trapezoidal shape;

a plurality of tabs, each of said tabs being coupled to and extending laterally away from said box, each of said tabs resting on the support surface, each of said tabs having a fastener extended therethrough and engaging the support surface for retaining said box on the support surface, each of said tabs and being aligned with said bottom wall of said box, said tabs being spaced apart from each other and being distributed around said box;

a cushion being positioned on said top wall of said box wherein said cushion is configured to be sat upon;

a door being hingedly coupled to said box, said door being aligned with said delivery opening for opening and closing said delivery opening, said door being positioned on said front wall of said box, said door being aligned with said delivery opening, said door having an inwardly facing surface and an outwardly facing surface;

a pair of grips, each of said grips being coupled to said outwardly facing surface of said door for gripping while opening and closing said door; and a locking unit being coupled to said box, said locking unit being operationally coupled to said door, said locking unit being urgeable into a locked condition when said door is opened such that said locking unit locks said door when said door is subsequently closed, wherein said locking unit secures the delivered parcel in said box until an authorized user unlocks said locking unit, said locking unit comprising:

a first lock being coupled to said top wall of said box, said lock extending through said top wall of said box, said first lock having a key hole being exposed with respect to said top wall;

a second lock being coupled to said inwardly facing surface of said door; and an armature being movably coupled between said first and second locks, said armature engaging said second lock when said locking unit is urged into said locking position, said armature disengaging said second lock when a key is inserted into said key hole for unlocking said locking unit.

* * * * *